United States Patent [19]

Wu

[11] Patent Number: 5,017,939

[45] Date of Patent: May 21, 1991

[54] TWO LAYER MATCHING DIELECTRICS FOR RADOMES AND LENSES FOR WIDE ANGLES OF INCIDENCE

[75] Inventor: Te-Kao Wu, Rancho Palos Verdes, Calif.

[73] Assignee: Hughes Aircraft Company, Los Angeles, Calif.

[21] Appl. No.: 412,703

[22] Filed: Sep. 26, 1989

[51] Int. Cl.[5] ..... H01Q 15/008; H01Q 19/060; H01Q 1/420

[52] U.S. Cl. ..... 343/911 R; 343/753; 343/872

[58] Field of Search ..... 343/753, 785, 872, 909, 343/911 R

[56] References Cited

U.S. PATENT DOCUMENTS

| | | | |
|---|---|---|---|
| 1,990,649 | 2/1935 | Ilberg | 343/872 |
| 2,415,352 | 2/1947 | Iams | 343/911 R |
| 2,659,884 | 11/1953 | McMillan et al. | 343/907 |
| 3,101,472 | 8/1963 | Goubau | 343/911 R |
| 3,435,458 | 3/1969 | Lewis | 343/753 |

FOREIGN PATENT DOCUMENTS

| | | | |
|---|---|---|---|
| 2441540 | 3/1976 | Fed. Rep. of Germany | 343/909 |
| 1043125 | 9/1966 | United Kingdom | 343/872 |

OTHER PUBLICATIONS

Hirsch et al., *Practical Simulation of Radar Antennas and Radomes,* Artech House (1987) pp. 167–231.

*Radome Engineering Handbook II,* Chap. 2, pp. 11–39.

Johnson et al., *Antenna Engineering Handbook 2d. Ed.,* Chapt. 44, pp. 44–2 to 44–25 (1984).

*Primary Examiner*—Rolf Hille

*Assistant Examiner*—Peter Toby Brown

*Attorney, Agent, or Firm*—Leonard A. Alkov; Wanda K. Denson-Low

[57] ABSTRACT

A multi-layered structure utilizes two impedance matching layers 4 and 6 and a base member 2 to provide an optimal transmission characteristic for double impedance matching layer structure. The multi-layered structure provides for optimal transmission of an electromagnetic signal for wide angles of incidence, and displays minimal sensitivity to the polarization of the signal.

6 Claims, 3 Drawing Sheets

TWO LAYER MATCHING DIELECTRICS FOR RADOMES AND LENSES FOR WIDE ANGLES OF INCIDENCE

BACKGROUND OF THE INVENTION

1. Technical Field

This invention relates to radomes and lenses and. more particularly to a radome or lens with two impedance matching layers.

2. Discussion

Electromagnetic antennas, including radar antennas are used under a variety of environmental conditions. Without protection, these antennas become vulnerable to the adverse effects of rain, heat, erosion, pressure and other sources of damage, depending upon where the antenna is used. Radar antennas, for instance, have been used in space-based, airborne, ship-borne and land-based applications. In each of these applications an antenna is subjected to a different set of environmental forces, some of which have the potential to render an unprotected antenna inoperable or severely damaged.

In order to protect an antenna from the adverse effects of its environment, antennas have been enclosed by shells which shield the antenna from its environment. The shielding of the antenna is typically accomplished by housing it within a relatively thin shell which is large enough so as not to interfere with any scanning motion of the antenna. The shielding shells used for radar antennas are typically called radomes.

A particular radome design is required to protect its antenna from the surrounding environment, while simultaneously not interfering with signals passed to and from the antenna and while not interfering with the overall performance of the system upon which the antenna is mounted. For instance, in airborne applications, a radome protects an antenna from aerodynamic forces and meteoric damage, while at the same time allowing radar transmission and reception, and while preventing the antenna from upsetting the aerodynamic characteristics of the airborne vehicle upon which it is mounted. Radomes are employed in ship-borne applications to protect antennas from wind and water damage, and from blast pressures from nearby guns.

Lenses have been used in connection with horn antennas to facilitate transmission and reception of electromagnetic signals. The lens is typically positioned in the path of the electromagnetic signal, and in front of the horn antenna The lens is used to bend or focus the signal, as the signal is transmitted or received.

Of particular importance are the electromagnetic characteristics of materials used in building the radome or lens. Currently, the structures used to produce radomes and lenses possess permittivities that are not equal to that of free space or of the atmosphere. The resulting impedance mismatch can cause reflections at the boundaries of the radome or lens, and can cause distortion and loss in the electromagnetic signal. The adverse consequences of an impedance mismatch become particularly acute when electromagnetic signals are transmitted or received from high angles of incidence with respect to the radome or lens. Attempts have been made in the past to minimize the effects of the impedance mismatch between the atmosphere or the free space that is in contact with the radome or the lens. For instance, prior attempts to match a radome or lens with a permittivity of:

$$\epsilon_{\text{randome or lens}} = 4 * \epsilon_0$$

($\epsilon_0$ being the permittivity of free space) have included a single impedance matching layer between the radome or lens and the atmosphere. This impedance matching layer has typically had a permittivity whose value falls between that of the atmosphere or free space, and the radome or lens. These previous impedance matching designs have shown good performance only when incoming electromagnetic signals have had small angles of incidence. These prior designs have also shown significant sensitivity to signal polarization.

SUMMARY OF THE INVENTION

The present invention provides an impedance matching design for a structure, such as a lens or radome, and its surrounding environment. The design employs two (2) impedance matching layers. The present invention provides an optimized transmission characteristic that exhibits minimal polarization sensitivity. In the preferred embodiment, a radome or lens with a permittivity greater than that of free space is matched to its surrounding environment through the use of two (2) optimized impedance matching layers.

BRIEF DESCRIPTION OF THE DRAWINGS

The various objects and advantages of the present invention will become apparent to those skilled in the art by reading the following specification and by reference to the drawings in which.

DESCRIPTION OF THE PREFERRED EMBODIMENT

Figure 1:
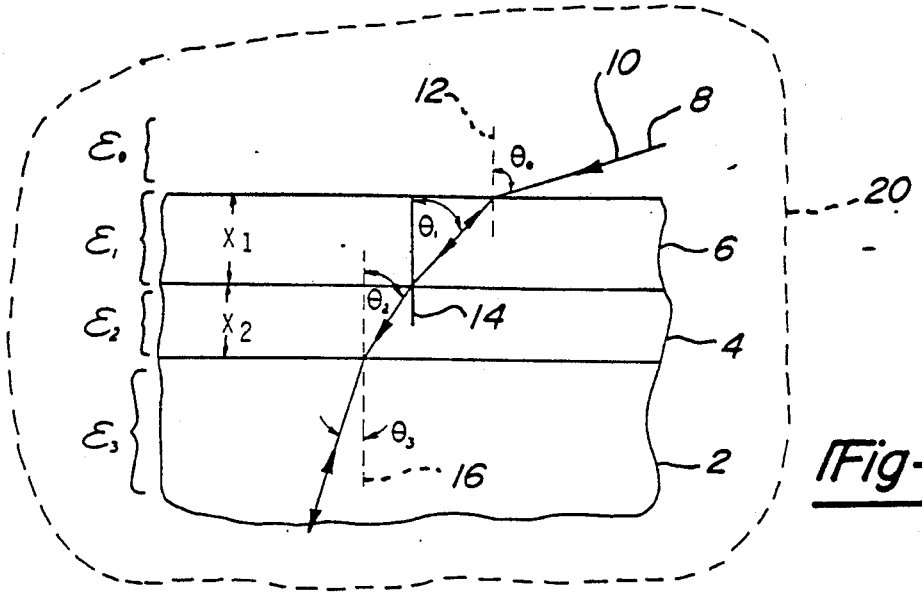
FIG. 1 is a ray tracing through four (4) dielectrics of increasing permittivity.

With reference now to the drawings, and more particularly to FIG. 1, there is shown a support or base member 2 with impedance matching layers 4 and 6, in contact with an adjacent ambient dielectric medium 8, such as air or free space. The permittivity of support or base member 2 is $\epsilon_3$, which is greater than the permittivity of impedance matching layer 4 The permittivity of impedance matching layer 4 is $\epsilon_2$, which is greater than the permittivity of impedance matching layer 6. The permittivity of impedance matching layer 6 is $\epsilon_1$, which is greater than the permittivity of adjacent ambient dielectric medium 8. The permittivity of adjacent ambient dielectric medium 8 is $\epsilon_0$, which is typically equal to the permittivity of the atmosphere or of free space. Incident ray 10 travels through the adjacent ambient dielectric medium 8, and represents the path of an electromagnetic signal that is being received by support or base member 2 from medium 8. However, the path of ray 10 could also represent an electromagnetic signal that is being transmitted from base member 2 to medium 8. Ray 10 creates an angle of incidence $\theta_0$, with respect to the normal 12 of the boundary between impedance matching layer 6 and adjacent ambient dielectric medium 8.

As is known in the art, as ray 10 travels across the boundary between adjacent ambient dielectric medium 8 and impedance matching layer 6, ray 10 will be refracted or bent in accordance with Snell's law. Therefore, because impedance matching layer 6 has a permittivity greater than that of adjacent ambient dielectric medium 8, angle $\theta_1$, will be less than the angle of incidence $\theta_0$. As ray 10 crosses the boundary between impedance matching layer 6 and impedance matching layer 4, it will again be refracted according to Snell's law. Ray 10 creates angle $\theta_1$ with respect to normal 14 of the boundary between impedance matching layer 4 and impedance matching layer 6. Because the permittivity of impedance matching layer 4 is greater than that of impedance matching layer 6, angle $\theta_2$ will be less than angle $\theta_1$. Similarly, as ray 10 crosses the boundary between impedance matching layer 4 and support or base member 2, it will again be refracted according to Snell's law. Because the permittivity of support or base member 2 is greater than that of impedance matching layer 4, angle $\theta_3$ with respect to the normal 16 of the boundary between impedance matching layer 4 and support or base member 2, will be less than angle $\theta_2$.

In a particularly useful (but not limiting) embodiment, the thickness $X_1$ of impedance matching layer 6 is 1.441 centimeters (cm) and the thickness $X_2$ of impedance matching layer 4 is 0.833 centimeters (cm) so that the layers 6 and 4 are tuned for an electromagnetic signal of frequency 6 GHz, as is shown in FIG. 1. As illustrated in FIG. 1, the permittivity $\epsilon_3$ of support or base member 2 is four (4) times that of the permittivity $\epsilon_0$ of adjacent ambient dielectric medium 8 ($4*\epsilon_0$). Based on this permittivity for support or base member 2, the optimal permittivity $\epsilon_2$ for impedance matching layer 4 is three (3) times the permittivity of adjacent ambient dielectric medium 8 ($3*\epsilon_0$). Similarly, the optimal permittivity $\epsilon_1$ for impedance matching layer 6 is 1.5 times the permittivity of adjacent ambient dielectric medium 8 ($1.5*\epsilon_0$). It will be readily apparent to those skilled in the art that thickness $X_2$ of impedance matching layer 4 and thickness $X_1$ of impedance matching layer 6 can be altered to tune these impedance matching layers for incident electromagnetic signals with frequencies other than 6 GHz. Similarly, the optimal transmission characteristics for both transverse magnetic and transverse electric polarizations of electromagnetic signals to or from an adjacent ambient dielectric medium 8 with permittivity $\epsilon_0$ can be achieved for a support or base member 2 with a given permittivity $\epsilon_3$ by using the following relation ships for the permittivity $\epsilon_2$ of matching layer 4 and the permittivity $\epsilon_1$ of matching layer 6:

$$\epsilon_0 = \text{permittivity of free space or air;}$$

$$\epsilon_1/\epsilon_2 = \sqrt{\epsilon_0/\epsilon_3}\ ;$$

$$\sqrt{\epsilon_3} \leqq \epsilon_2 \leqq \epsilon_3;$$

$$\text{for } \epsilon_0 \leqq \epsilon_3;$$

for angles of incidence $0 \leqq \theta_0 \leqq 60°$; for electromagnetic signals ranging from microwave to optical frequencies; and for a 60% transmission bandwidth around the tuning frequency.

While FIG. 1 illustrates an embodiment of the present invention that has a planar or flat shape, it should be understood that the present invention can be effectively embodied in a curved multilayered structure, such as a curved radome or lens. A curved radome or lens will realize the present invention's advantages provided that the curvature of the radome or lens is "electrically large" with respect to the incident or transmitted electromagnetic signals. As is known in the art, a curved multi.layered structure is electrically large with respect to a given signal if the radius of curvature of the multilayered structure is significantly larger than the wavelength of the given electromagnetic signal. As is known in the art, when a multilayered structure is electrically large the multi.layered structure may be locally approximated as a planar or flat multi.layered structure as illustrated in FIG. 1.

Figure 2:
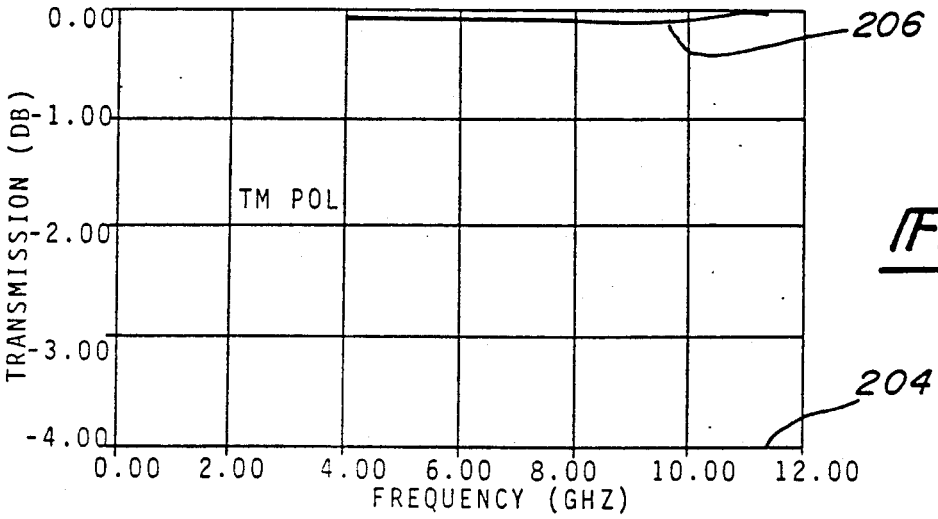
FIG. 2 is a graph illustrating the transmission characteristics of electromagnetic energy in the transverse magnetic polarization for a structure having two (2) optimized impedance matching layers for an incident angle of sixty degrees (60°)

Turning now to FIG. 2, there is shown the transmission characteristics of a multi-layered structure comprised of a support or base member with two (2) optimized impedance matching layers, like that of FIG. 1, for electromagnetic signals in the transverse magnetic polarization. Transmission in decibels is plotted along axis 202 function of signal frequency in GHz plotted along axis 204. Curve 206 illustrates the transmission characteristic for a range of signal frequencies near 6 GHz, and for an electromagnetic signal passing to or from adjacent ambient dielectric medium 8 at an angle of incidence $\theta_0$ of sixty degrees (60°) upon impedance matching layer 6. The transmission characteristic of FIG. 2 illustrates the situation where the thicknesses $X_1$ and $X_2$, and the permittivities of impedance matching layers 6 and 4, the permittivity of the support or base member 2, and the permittivity of the adjacent ambient dielectric medium 8 are all equal to those illustrated in FIG. 1.

Figure 3:
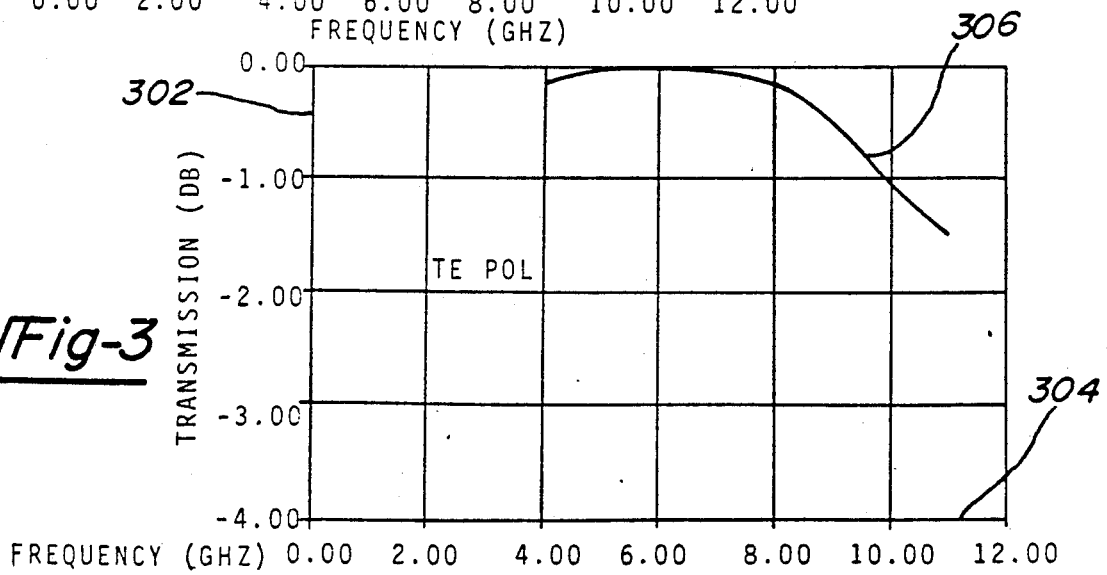
FIG. 3 is a graph illustrating the transmission characteristics of electromagnetic energy in the transverse electric polarization for a structure having the same two (2) optimized impedance matching layers as in FIG. 2 for an incident angle of sixty degrees (60°)

Turning to FIG. 3, there is shown the transmission characteristics of a multi-layered structure comprised of a support or base member with two (2) optimized impedance matching layers, like that of FIG. 1, for electromagnetic signals in the transverse electric polarization. Transmission in decibels is plotted along axis 302 as a function of signal frequency in GHz plotted along axis 304 for the same surface used to generate the characteristic of FIG. 2. Curve 306 illustrates the transmission characteristic for a range of signal frequencies near 6 GHz, and for an electromagnetic signal passing to or from adjacent ambient dielectric medium 8 at an angle of incidence $\theta_0$ of sixty degrees (60°) upon impedance matching layer 6. The transmission characteristic of FIG. 3 illustrates the situation where the thicknesses $X_1$ and $X_2$, and the permittivities of impedance matching layers 6 and 4, the permittivity of the support or base member 2, and the permittivity of the adjacent ambient dielectric medium 8 are all equal to those illustrated in FIG. 1.

Figure 4:
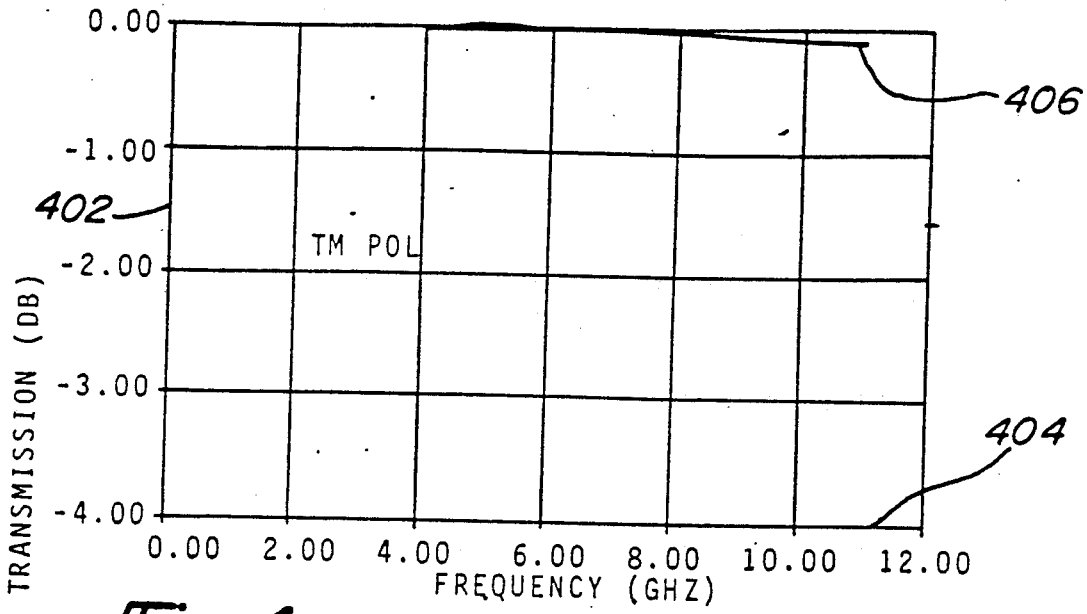
FIG. 4 is a graph illustrating the transmission characteristics of electromagnetic energy in the transverse magnetic polarization for a structure having the same two (2) optimized impedance matching layers as in FIG. 2 for an incident angle of fifty degrees (50°)

Turning to FIG. 4, there is shown the transmission characteristics of a multi.layered structure comprised of a support or base member with two (2) optimized impedance matching layers, like that of FIG. 1, for electromagnetic signals in the transverse magnetic polarization. Transmission in decibels is plotted along axis 402 as a function of signal frequency in GHz plotted along axis 404 for the same surface used to generate the characteristic of FIG. 2. Curve 406 illustrates the transmission characteristic for a range of signal frequencies near 6 GHz, and for an electromagnetic signal passing to or from adjacent ambient dielectric medium 8 at an angle of incidence $\theta_0$ of fifty degrees (50°) upon impedance matching layer 6. The transmission characteristic of FIG. 4 illustrates the situation where the thicknesses $X_1$ and $X_2$, and the permittivities of impedance matching layers 6 and 4, the permittivity of the support or base member 2, and the permittivity of the adjacent ambient dielectric medium 8 are all equal to those illustrated in FIG. 1.

Figure 5:
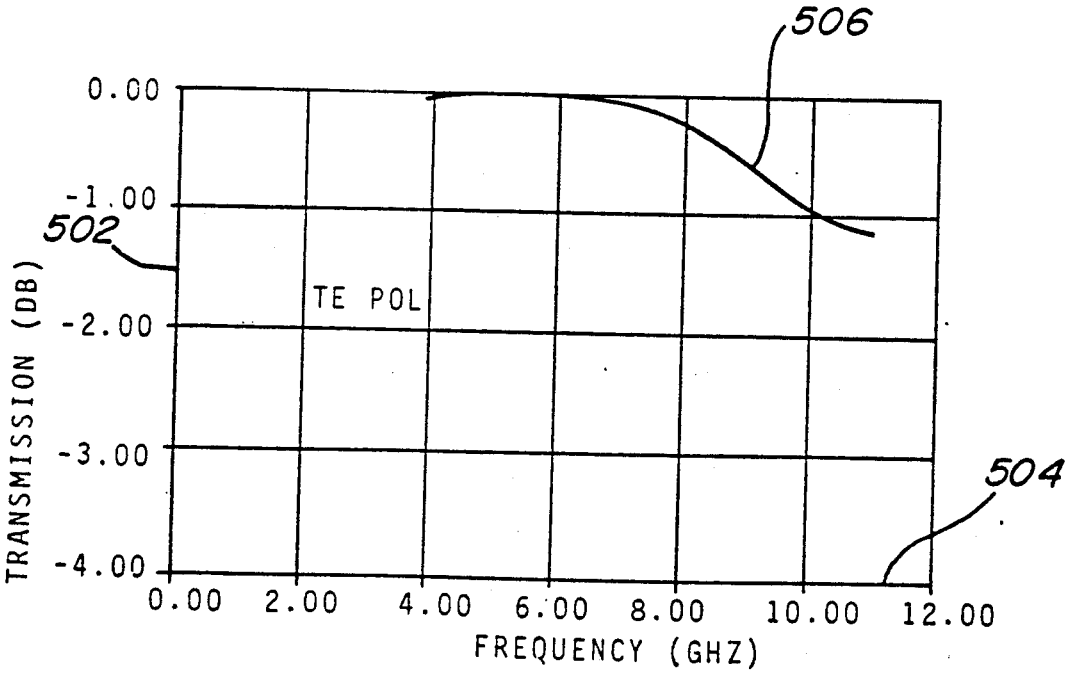
FIG. 5 is a graph illustrating the transmission characteristics of electromagnetic energy in the transverse electric polarization for a structure having the same two (2) optimized impedance matching layers as in FIG. 2 for an incident angle of fifty degrees (50°)

Turning now to FIG. 5, there is shown the transmission characteristics of a multi.layered structure comprised of a support or base member with two (2) optimized impedance matching layers, like that of FIG. 1, for electromagnetic signals in the transverse electric polarization. Transmission in decibels is plotted along axis 502 as a function of signal frequency in GHz plotted along axis 504 for the same surface used to generate the characteristic of FIG. 2. Curve 506 illustrates the transmission characteristic for a range of signal frequencies near 6 GHz, and for an electromagnetic signal passing to or from adjacent ambient dielectric medium 8 at an angle of incidence $\theta_0$ of fifty degrees (50°) upon impedance matching layer 6. Similarly, the transmission characteristic of FIG. 5 illustrates the situation where the thicknesses $X_1$ and $X_2$, and the permittivities of impedance matching layers 6 and 4, the permittivity of the support or base member 2, and the permittivity of the adjacent ambient dielectric medium 8 are all equal to those illustrated in FIG. 1.

Figure 6:
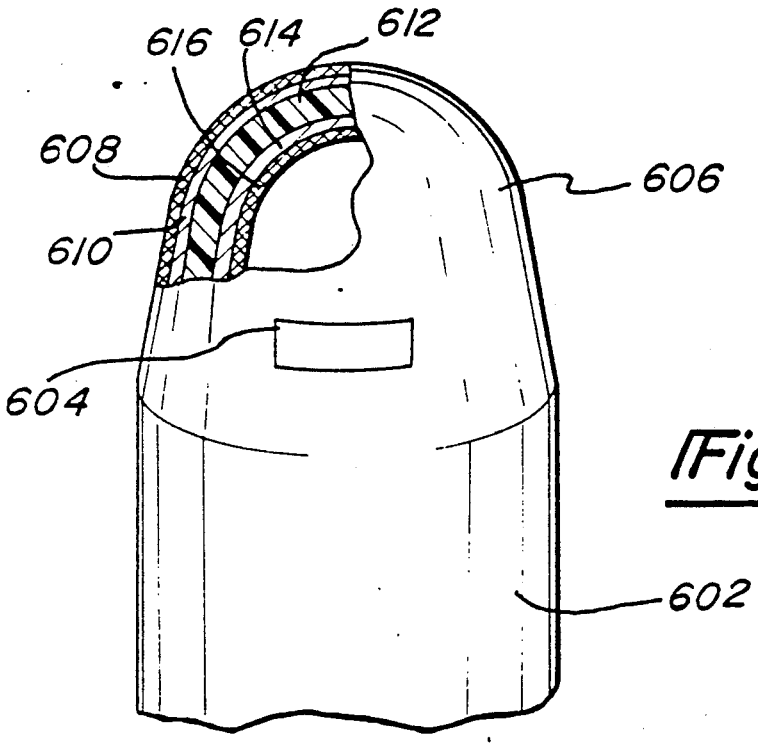
FIG. 6 is an environmental view showing a radome made in accordance with the teachings of this invention, the radome being mounted on an airborne vehicle.
Figure 7:
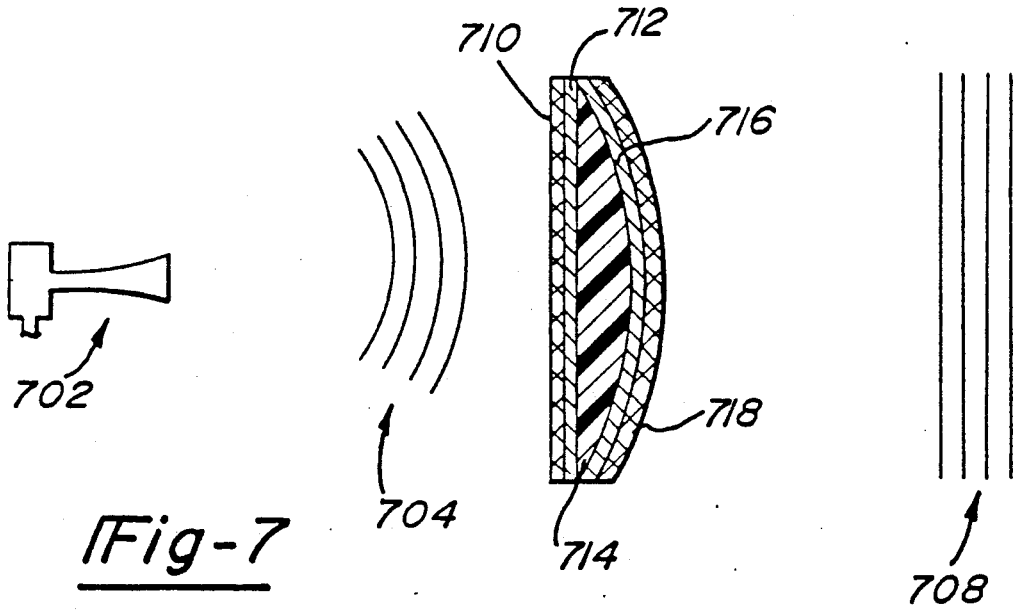
FIG. 7 is an environmental view showing a focusing device made in accordance with the teachings of this invention, the focusing device being used to bend incoming and outgoing electromagnetic signals in connection with a horn antenna.

Turning now to FIGS. 6 and 7, there is illustrated two (2) views of embodiments made in accordance with the teachings of this invention. FIG. 6 illustrates the use of a radome made in accordance with the teachings of the present invention in connection with an airborne vehicle 602. Radar antenna 604 is housed within the radome. Radome 606 is shown as having a cut away portion, exposing the layers of the structure that are used to create radome 606. Layer 608 is a first impedance matching layer substantially identical to layer 6 in FIG. 1. Layer 610 is an impedance matching layer substantially identical to layer 4 in FIG. 1. Shell 612 is a base member substantially identical to base member 2 in FIG. 1. Layer 614 is an impedance matching layer substantially identical to layer 4 in FIG. 1. Similarly, layer 616 is an impedance matching layer substantially identical to layer 6 in FIG. 1. In the typical radome, both sides of a shell 612 must be matched to its surrounding environment because there is typically an atmosphere or free space in contact with both sides of the shell. Because both sides of a given shell must pass electromagnetic energy to and from an adjacent ambient dielectric medium, the typical radome made in accordance with the present invention will use two (2) impedance matching layers on each side of a given shell.

FIG. 7 illustrates the use of a focusing device 706 made in accordance with the teachings of the present invention in connection with a horn antenna 702. Focusing device 706 is shown as being comprised of four (4) impedance matching layers 710, 712, 716 and 718 and lens 714. Layer 710 is an impedance matching layer substantially identical to layer 6 in FIG. 1. Layer 712 is an impedance matching layer substantially identical to layer 4 in FIG. 1. Layer 716 is an impedance matching layer substantially identical to layer 4 in FIG. 1. Similarly. layer 718 is an impedance matching layer substantially identical to layer 6 in FIG. 1. Lens 714 is a base member substantially identical to base member 2 in FIG. 1. Without impedance matching layers 710, 712, 716 and 718, both sides of lens 714 would be in contact with the adjacent ambient dielectric medium such as air or free space in the surrounding environment. In order to match the permittivity of lens 714 with its surrounding environment, focusing device 706 is made in accordance with the present invention and includes two (2) impedance matching layers on each side of lens 714.

A substantially planar wave 708 is shown as being incident on lens 706. Wave 708 is bent by lens 706 as it passes through the lens. A substantially spherical wave 704 is transmitted from lens 706 to horn antenna 702. Typically, horn antenna 702 can transmit as well as receive electromagnetic signals. FIG. 7 illustrates transmission as well as reception. When transmitting, horn antenna 702 emits a substantially spherical wave 704. Wave 704 is incident upon lens 706. Lens 706 bends wave 704 and transits a substantially planar wave 708.

It should be understood that while this invention was described in connection with one particular example, that other modifications will become apparent to those skilled in the art after having the benefit of studying the specification, drawings and following claims.

What is claimed is:

1. A multi-layered structure having a base or support member for receiving and passing incident electromagnetic energy to and from an adjacent ambient dielectric medium, said multi-layered structure comprising:

a first impedance matching layer in contact with said adjacent ambient dielectric medium, said first impedance matching layer having a permittivity higher than that of said adjacent ambient dielectric medium;

a second impedance matching layer in contact with said first impedance matching layer, said second impedance matching layer having a permittivity higher than that of said first impedance matching layer, wherein said permittivity of said second impedance matching layer is greater than a square root of said permittivity of said support or base member, and, wherein said permittivity of said first impedance matching layer divided by said permittivity of said second impedance matching layer is equal to the square root of said permittivity of said adjacent ambient dielectric medium divided by the square root of said permittivity of said support or base member, wherein said permittivity of said second impedance matching layer is 3 times the permittivity of said adjacent ambient dielectric medium, ($3*\epsilon_0$), wherein said permittivity of said first impedance matching layer is 1.5 times the permittivity of said adjacent ambient dielectric medium ($1.5*\epsilon_0$), wherein said second impedance matching layer has a thickness of 0.833 centimeters (cm), and wherein said first impedance matching layer has a thickness of 1.441 centimeters (cm);

said support or base member being in contact with said second impedance matching layer, said base member having permittivity higher than that of said second impedance matching layer wherein said permittivity of said support or base member is 4 times (*) the permittivity of said adjacent ambient dielectric medium ($4*\epsilon_0$); and said multi-layered structure providing a substantially optimized transmission bandwidth for both transverse electric and transverse magnetic polarizations of said electromagnetic energy for wide angles of incidence.

2. The multi-layered structure of claim 1 wherein said two impedance matching layers used in conjunction with a radome or lens provide a substantially optimized transmission bandwidth for both transverse electric and transverse magnetic polarizations of said electromagnetic energy for an angle of incidence from 0 to 60 degrees.

3. The multi-layered structure of claim 1, wherein the base member is a shell of a radome.

4. The multi-layered structure of claim 1, wherein the base member is a lens of a focusing device.

5. A radome for receiving and passing incident electromagnetic energy to and from an adjacent ambient dielectric medium, said randome comprising:

a first impedance matching layer in contact with said adjacent ambient dielectric medium, said first impedance matching layer having a permittivity higher than that of said adjacent ambient dielectric medium;

a second impedance matching layer in contact with said first impedance matching layer, said second impedance matching layer having a permittivity higher than that of said first impedance matching layer, wherein the permittivity of said second impedance matching layer is 3 times the permittivity of said adjacent ambient dielectric medium, ($3*\epsilon_0$) and wherein the permittivity of the first impedance matching layer is 1.5 times the permittivity of said adjacent ambient dielectric medium ($1.5 *\epsilon_0$);

a shell in contact with said second impedance matching layer, said shell having a permittivity higher than that of said second impedance matching layer, wherein said permittivity of said second impedance matching layer is greater than the square root of said permittivity of said shell, and wherein said permittivity of said first impedance matching layer divided by said permittivity of said second impedance matching layer is equal to the square root of said permittivity of said adjacent ambient dielectric medium divided by the square root of said permittivity of said shell, and wherein said permittivity of said shell is 4 times (*) the permittivity of said adjacent ambient dielectric medium, ($4*\epsilon_0$);

said two impedance matching layers cooperating with said shell to provide a substantially optimized transmission bandwidth for both transverse electric and transverse magnetic polarizations of said electromagnetic energy for angles of incidence of 0 to 60 degrees;

a third impedance matching layer in contact with said shell, said third layer being in contact with the surface of said shell opposite to the surface of said shell that is in contact with said second layer, said third layer having a permittivity equal to said permittivity of said second layer;

a fourth impedance matching layer in contact with said third layer on one side and in contact with said adjacent ambient dielectric medium on the other side, said fourth layer having a permittivity equal to said permittivity of said first layer; and wherein said second and said third impedance matching layers have a thickness of 0.833 centimeters (cm), and, wherein said first and said fourth impedance matching layers have a thickness of 1,441 centimeters (cm.); and said four impedance matching layers cooperating with said shell to provide a substantially optimized transmission bandwidth for both transverse electric and transverse magnetic polarizations of said electromagnetic energy for angles of incidence of 0 to 60 degrees.

6. A focusing device for receiving and passing incident electromagnetic energy to and from an adjacent ambient dielectric medium, said focusing device comprising:

a first impedance matching layer in contact with said adjacent ambient dielectric medium, said first impedance matching layer having a permittivity higher than that of said adjacent ambient dielectric medium;

a second impedance matching layer in contact with said first impedance matching layer, said second impedance matching layer having a permittivity higher than that of said first impedance matching layer wherein said permittivity of said second impedance matching layer is 3 times the permittivity of said adjacent ambient dielectric medium, ($3*\epsilon_0$), and, wherein said permittivity of said first impedance matching layer is 1.5 times the permittivity of said adjacent ambient dielectric medium ($1.5\epsilon_0$);

a lens in contact with said second impedance matching layer, said lens having a permittivity higher than that of said second impedance matching layer wherein the permittivity of said lens is 4 times (*) the permittivity of said adjacent ambient dielectric medium, ($4*\epsilon_0$), wherein said permittivity of said second impedance matching layer is greater than the square root of said permittivity of said lens, and wherein said permittivity of said second impedance matching layer is equal to the square root of said permittivity of said adjacent ambient dielectric medium divided by the square root of said permittivity of said lens;

said two impedance matching layers cooperating with said lens to provide a substantially optimized transmission bandwidth for both transverse electric and transverse magnetic polarizations of said electromagnetic energy for angles of incidence of 0 to 60 degrees;

a third impedance matching layer in contact with said lens, said third layer being in contact with the surface of said lens opposite to the surface of said lens that is in contact with said second layer, said third layer having a permittivity equal to said permittivity of said second layer;

a fourth impedance matching layer in contact with said third layer on one side and in contact with said adjacent ambient dielectric medium on the other side, said fourth layer having a permittivity equal to said permittivity of said first layer, wherein said second and said third impedance matching layers have a thickness of 0.833 centimeters (cm), and wherein said first and said fourth impedance matching layers have a thickness of 1,441 centimeters (cm); and said four impedance matching layers cooperating with said lens to provide a substantially optimized transmission bandwidth for both transverse electric and transverse magnetic polarizations of said electromagnetic energy for angles of incidence of 0 to 60 degrees.

* * * * *